United States Patent [19]

Siemers

[11] Patent Number: 4,805,294

[45] Date of Patent: Feb. 21, 1989

[54] METHOD FOR FINISHING THE SURFACE OF PLASMA SPRAYED TI-ALLOY FOILS

[75] Inventor: Paul A. Siemers, Clifton Park, N.Y.

[73] Assignee: General Electric Company, Schenectady, N.Y.

[21] Appl. No.: 10,883

[22] Filed: Feb. 4, 1987

[51] Int. Cl.[4] ..... B21B 1/46

[52] U.S. Cl. ..... 29/527.7; 164/46; 427/34

[58] Field of Search ..... 29/527.7; 164/46; 427/34

[56] References Cited

U.S. PATENT DOCUMENTS

| | | | |
|---|---|---|---|
| 3,427,185 | 2/1969 | Chedtham et al. | 29/419 |
| 3,606,667 | 9/1971 | Kreider . | |
| 4,141,802 | 2/1979 | Duparque et al. | 204/15 |
| 4,574,451 | 3/1986 | Smashey et al. | 29/423 |
| 4,576,828 | 3/1986 | Walker, Jr. | 427/34 |

FOREIGN PATENT DOCUMENTS

| | | |
|---|---|---|
| 7074115 | 5/1982 | Japan . |
| 7074117 | 5/1982 | Japan . |

*Primary Examiner*—Donald P. Walsh

*Attorney, Agent, or Firm*—Paul E. Rochford; James C. Davis, Jr.; James Magee, Jr.

[57] ABSTRACT

An improved method of forming titanium alloy in sheet form is taught. The sheet is formed by plasma spraying larger particles of greater than 100 μm diameter onto a receiving surface to form a sheet having a rough surface due to the larger particles. An RF powered gun is employed to form the deposit using the larger particles. The formed sheet is separated from the substrate and rolled to reduce the sheet thickness as well as to render the rough surface smoother and more even.

11 Claims, 5 Drawing Sheets

RF DEPOSITED Ti-6AL-4V: AS DEPOSITED

RF DEPOSITED Ti-6AL-4V: COLD ROLLED

RF DEPOSITED Ti-14AL-21CB: AS DEPOSITED

RF DEPOSITED Ti-14AL-21Cb: COLD ROLLED

METHOD FOR FINISHING THE SURFACE OF PLASMA SPRAYED TI-ALLOY FOILS

RELATED APPLICATIONS

The subject invention relates to copending applications. One copending application is Ser. No. 010655 (2/87), filed 2/87 and entitled "Method of Fabricating Titanium Alloys in Foil Form" is concerned with the method for fabricating thin foils for filament reinforced composites. A second copending application is Ser. No. 000654 (2/87), filed 2/87 and titled "Method for Continuous Fabrication of SiC Reinforced Ti-Based Composites". A third copending application is Ser. No. 010882, filed 2/87 and entitled "Silicon Carbide Reinforced Composites of Titanium Base Alloys". The texts of the copending applications and the applications referenced therein are incorporated herein by reference.

BACKGROUND OF THE INVENTION

The present invention relates generally to the formation of structure in which titanium-alloy sheet material forms a component part. More particularly the invention relates to improved methods for forming sheets for incorporation as components into multiple sheet structures such as homeycomb structures and reinforced sheet structures and the like.

Titanium base alloys have been identified as potential matrix materials for use in metal matrix composites. Such composites may be formed, for example, by layering up multiple thin layers of the titanium with other materials. They have also been identified as potential ingredients for filament reinforced composite structures. Further they have been identified as components for super plastically formed diffusion bonded homeycomb structures.

The subject application relates generally to the first two copending applications referenced above in relevant subject matter. The methods described above relate to the formation of sheet articles of titanium by plasma deposition of titanium alloy onto a receiving surface which may be a rotating drum. Various uses are then made of the foil which is formed on the receiving surface in forming composite articles or in receiving reinforcement as with silicon carbide fibers to fabricate high performance structures.

I have found that the preferred powder size for use in the deposition of titanium alloys to form the sheet or foil products as referred to above is about 100 to about 250 μm or greater and that it is preferred to deposit such powder using a RF powered plasma gun. When a foil is prepared with a structure formed from such larger size particles the as-sprayed surface roughness of the RF plasma sprayed foils can be quite high. The surface roughness can result in poor packing efficiency of titanium-alloy foils and SiC fibers.

Further such roughness can possibly lead to damage of the filaments which are to be embedded therebetween in pressurization steps or during HIPing or hot pressing consolidation processes. From work done with regard to such foils and thin sheet materials it has become evident that it is desirable to reduce the surface roughness in order to improve the usefulness of the foil formed by the plasma spray deposit process.

Novel and unique structures are formed pursuant to the present invention by plasma spray deposition of titanium base alloys and titanium-aluminum intermetallic compounds employing RF plasma spray apparatus and by then modifying the as-sprayed deposit.

The formation of plasma spray deposits of titanium base alloys, including intermetallic compounds of titanium, present a set of processing problems which are unlike those of most other high temperature high strength materials such as the superalloys. A superalloy such as a nickel base or iron base superalloy can be subdivided to relatively small size particles of −400 mesh (about 37 μm) or smaller without causing the powder to accumulate a significant surface deposit of oxygen. A nickel base superalloy in powder form having particle size of less than −400 mesh will typically have from about 200 to about 400 parts per million of oxygen. A powdered titanium base alloy by contrast will typically have a ten fold higher concentration of oxygen. A powdered titanium base alloy of −400 mesh will have between about 2000 and 4000 ppm of oxygen.

Moreover titanium base alloy powder of less than −400 mesh size is recognized as being potentially pyrophoric and as requiring special handling to avoid pyrophoric behavior.

It is also recognized that the low temperature ductility of titanium base alloys decreases as the concentration of oxygen and of nitrogen which they contain increases. It is accordingly important to keep the oxygen and nitrogen content of titanium base alloys at a minimum.

Prior art plasma spray technology is based primarily on use of direct current plasma guns. It has been recognized that most as-sprayed plasma spray deposits of the superalloys such as nickel and iron base superalloys have had relatively low ductility and that such deposits when in their sheet form can be cracked when bent through a sufficiently acute angle due to the low ductility. Such plasma spray deposits do acquire improved properties based on heat treatment. However in the as-sprayed form they do have very limited ductility and are subject to cracking as noted.

I have discovered that RF plasma apparatus is capable of spraying powder of much larger particle size than the conventional d.c. plasma apparatus. I have discovered that particle sizes at least three times larger in diameter than those conventionally employed in d.c. plasma spray apparatus may be successfully employed as plasma spray practices and that the particle size may be as high as 100 μm to 250 μm and larger and as large as 10X as large as the −400 mesh powder previously employed in d.c. plasma spray practice.

This possiblity of employing the larger powder particles is quite important and for metal powders such as titanium base alloys which are subject to reactions and absorption of gases such as nitrogen and oxygen on their surfaces. One reason is that the surface area of particles relative to their mass decreases inversely as their diameters. Accordingly a three fold increase in particle diameter translates into a three fold decrease in particle suface area to volume. I have discovered that one result is that RF plasma spray deposited structures of titanium base alloys made with the aid of larger particles have lower oxygen content than might be expected based on knowledge of prior art practices.

As used herein the term titanium base alloys means an alloy composition in which titanium is at least half of the composition in parts by weight when the various alloy constituents are specified as in percentage by weight.

A titanium-aluminum intermetallic compound is a titanium base alloy composition in which titanium and aluminum are present in a simple numerical atomic ratio and the titanium and aluminum are distributed in the composition in a crystal form which corresponds to the simle numerical ratio such as 3:1 for $Ti_3Al$, 1:1 for TiAl; and 1:3 for $TiAl_3$.

$Ti_3Al$ compositions have use temperatures of up to about 1400° F. as compared to the use temperature of titanium alloys such as Ti-6Al-4V of up to about 1000° F. The use temperature of TiAl is in the 1700°-1800° F. range.

BRIEF DESCRIPTION OF THE INVENTION

It is accordingly one object of the present invention to reduce the surface roughness of RF plasma deposited foils to adapt them for consolidation into composite structures.

Another object is to provide a method of forming a smooth thin foil of a titanium alloy especially adapted for consolidation into composite structures.

Another object is to provide improved composite structures formed with titanium base alloy component layers.

Another object is to provide a means for producing titanium based foils at low cost.

Other objects will be in part apparent and in part pointed out in the description which follows.

In one of its broader aspects objects of this invention may be achieved by providing an Rf plasma gun, supplying powder to said gun of at least about 100 μm in diameter for plasma spray deposit, spray depositing said powder onto a substrate to form a foil, separating the foil from the substrate, and rolling the foil to reduce the surface roughness thereof.

In another of its broader aspects objects of the invention can be achieved by forming a plurality of foils by plasma spray deposition techniques, rolling each of the formed foils to reduce the overall thickness and to reduce the surface roughness thereof, mounting said plurality of foils and other components into a pre-composite assembly, and subjecting said assembly to heat and pressure to consolidate said assembly into a composite structure.

The present invention is based on the discovery that it is possible to cold roll "as-sprayed" RF plasma deposited titanium alloys without cracking. The cold rolling significantly reduces the surface roughness of the foil and further reduces its thickness. It has further been discovered that a plasma sprayed titanium-alloy foil which is later cold rolled represents a significant cost reduction over the more conventional methods for fabricating such foils.

BRIEF DESCRIPTION OF THE DRAWINGS

The description of the invention which follows will be understood more clearly if in reading the following specification reference is made to the accompanying drawings in which.

DETAILED DESCRIPTION OF THE PRESENT INVENTION

Figure 1:
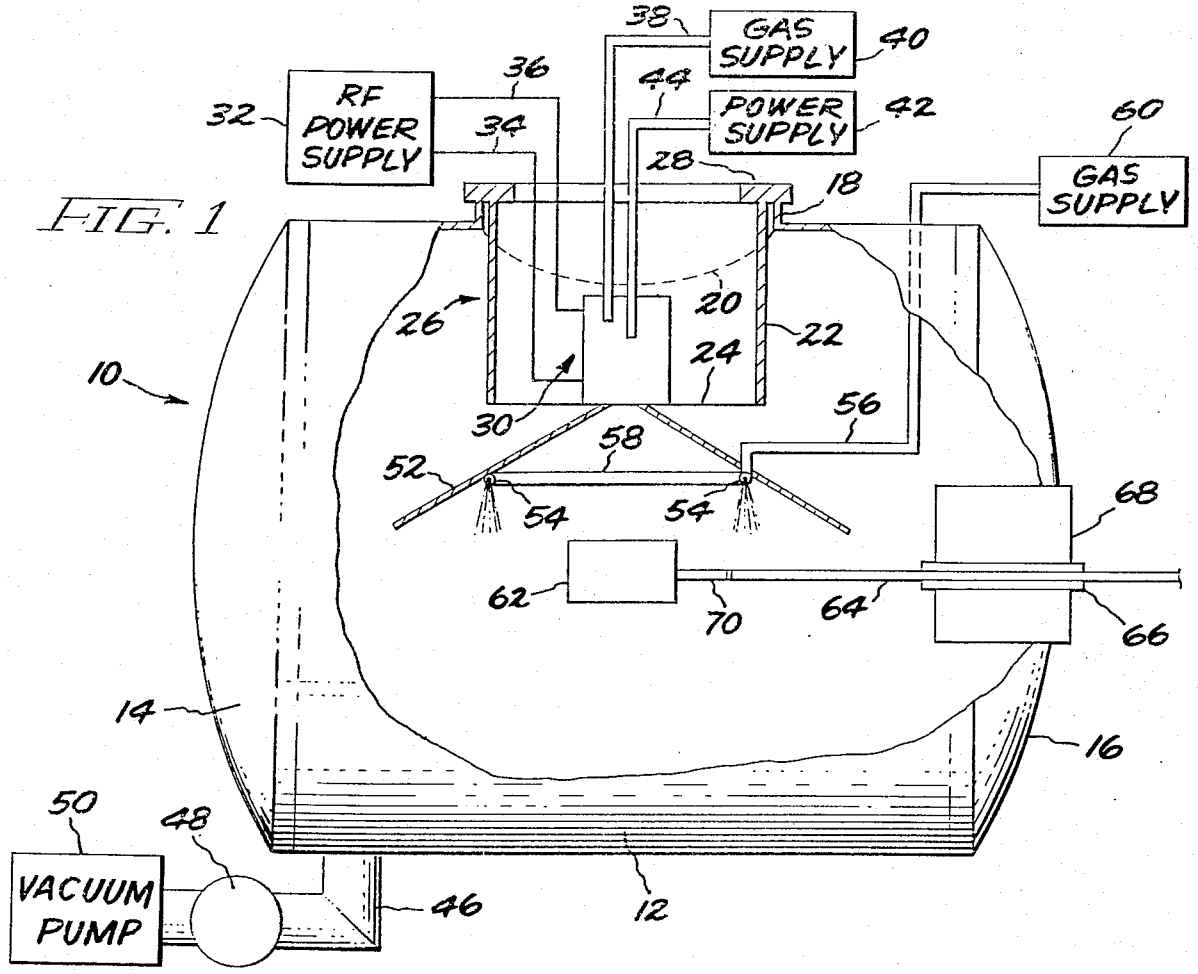
FIG. 1 is a schematic diagram of a system for low pressure RF plasma deposition onto a rotatable drum as a plasma spray receiving surface.

A low pressure radio frequency plasma spray deposite apparatus 10 is made up of a tank 12 having two removable end caps 14 and 16 and the associated apparatus as illustrated in FIG. 1. The tank may have a length of about 5 feet and a diameter of about 5 feet.

At the top of the tank 12 provision is made for introduction of an RF plasma gun into the top of the tank through an opening formed by cutting an opening and welding a collar 18 to the top of tank 12 along seam 20. The RF gun introduced into the tank is positioned within a container in the form of an inverted hat. The hat has sidewalls 22 and bottom wall 24 and has a rim 28 which seats on the collar 18 to provide a hermetic seal by techniques well known in the art.

The gun itself 30 is described in greater detail with reference to FIG. 2. The gun is mounted to the bottom wall 24 of the inverted hat container 26 and is supplied by power and by gas and powder entrained in a carrier gas.

An RF power supply 32 delivers power to the gun 30 over lines 34 and 36. Details of its operation are given below with reference to FIG. 2.

Gas is supplied to the interior of gun 30 from gas supply means such as 40 through piping such as 38. A variety of gases such as hydrogen, argon, helium, etc., may be used and the gases may be supplied for axial or radial or swirl flow as may be required for the needs of a specific gun such as a TAFA Model 66 RF gun as described below. Only one gas supply means 38 is shown in FIG. 1 for simplicity of illustration.

Also, powder entrained in a carrier gas is supplied to the plasma gun from a powder supply means 42 through piping 44.

A low pressure of about 200 to 400 torr is maintained within the tank 12 by means of a pump 50 operating through valve 48 and line 46 connected to the tank 12.

A problem of arc striking against wall interiors from the plasma was studied and was overcome by incorporation of a conical shield 52 extending down from gun 30 and by use of gas jets 54 disposed around the plasma flame from gun 30. Cold gas is supplied to the jets through the pipe 56 from exterior gas supply means 60. The jets are formed by gas flow through openings drilled through an annular pipe mounted beneath conical shield 52. The pipe 58 serves as a manifold for the gas as well as providing the bottom drilled openings from which the gas jets 54 emerge.

The object illustrated as that to be coated by plasma spray deposit is a drum 62 held by attachment bolt 70 at the end of an arm 64 extending through one end cap 16 of the tank 12. the arm 64 is hermetically sealed through the end cap 16 by a bushing 66 which is mounted within the box 68. Conventional means are provided in the box 68 for vertical positioning of the busing 66 before the apparatus is evacuated. The rod may be raised or lowered to permit the position of drum 62 or other sample attached at the end of rod 64 to be adjusted to appropriate positions for the coating process to be performed prior to evacuation of tank 12.

While the plasma spray deposition is in progress, sliding lateral positioning of the drum by inward and outward movement of rod 64 through bushing 66 is also feasible. The drum is subject to rotation by imparting a rotary motion to the external portion of rod 64 by conventional means.

Figure 2:
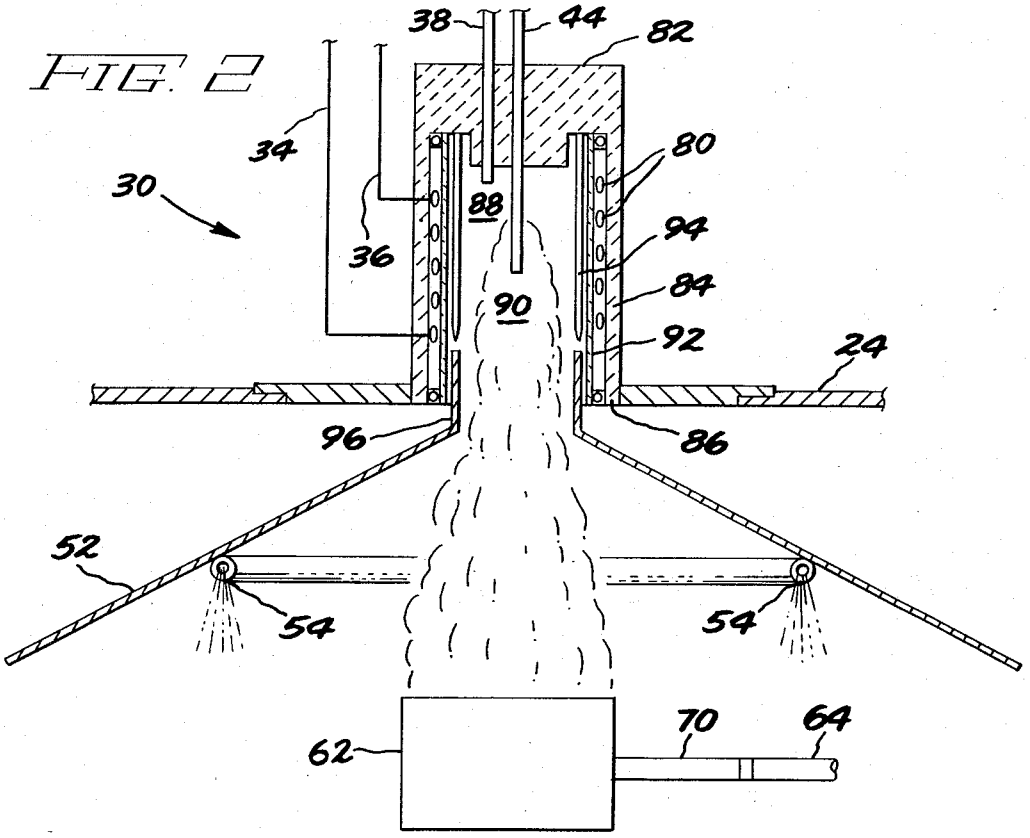
FIG. 2 is a schematic illustration of some details of a low pressure RF plasma gun and deposition apparatus.

Turning now to FIG. 2, a more detailed description of the plasma gun and its operation is provided.

The elements shown in both FIGS. 1 and 2 which bear the same reference numerals are the same articles. It is evident from FIG. 2 that the gun 30 has RF electric supply means 34 and 36 which are the same as those illustrated in FIG. 1. These means are known in the art to be hollow tubes which carry the RF energy and which also carry water to and from the gun for water cooling. Water cooling is necessary because of the high temperature of 10,000° to 12,000° K. generated within the gun.

Also, the gas supply means 38 and powder supply pipe 44 are provided in supply relationship to the elements of gun 30 as they were in FIG. 1. The powder supply means is also water cooled.

The gun 30 is provided with a housing, which includes a closed top wall 82, side walls 84 and a lower opening 86 from which the plasma flame extends.

Powder supply means 44 is a triple wall tube having a hollow innermost center tube for supply of powder and carrier gas. The triple wall is made up of a set of three concentric tubes having a cooling liquid, such as water, flowing in cooling relation in the inner and outer passages between the concentric tubes of powder supply means 44.

Gas supply means 38 extends into the portion of chamber 88 which is above the plasma and accordingly need not be water cooled. The plasma itself is generated by having the radio frequency power impressed on the gas within the central portion of chamber 88. A suitable frequency range is from 2 to 5 megahertz. The lower end of this range is preferred.

The RF power is delivered through the lines 34 and 36 to a water cooled annular chamber in which helical coil turns 80 lies concentric to the sidewalls 84 of the gun 30. Individual strands 80 of the coil are evident in section in FIG. 2. The RF coil, made up of strands 80, is separated from the chamber 88 and plasma 90 by the quartz tube 92 mounted as a liner within the gun 30 and forming one wall of the water cooled annular chamber.

A water cooled copper liner 94 made up of a ring of water cooled fingers is also provided in gun 30 within quartz tube 92 as it has been found to assist the operation of the gun at higher powers.

An exit baffle 96 assists in orienting the flame of the plasma gun 30. The plasma 90 is formed within gun 30 and extends from the bottom of the gun downward into heat delivering relation to the target 62 mounted at the end of rod 64 by a bolt 70.

As explained above, I have found that a combination of the stainless steel shield 52 and the gas jets 54 have been successful in preventing an arc or striking back from the plasma to the walls of the container of the low pressure plasma deposition apparatus 10 as illustrated in FIG. 1.

In operation, a gas or combination of gases, based on the design of the gun is passed through tube or combination of tubes 38 into chamber 88 and the pressure of this gas is kept at a low value by the action of vacuum pump 50 operating through valve 48 and pipe 46 on the low pressure plasma deposition apparatus including tank 12. A pressure of about 250 torr is suitable. The tank itself has a length of about five feet and also a diameter of about five feet. Radio frequency power is impressed on the strands 80 of the coil to excite the gas or gases passing into the housing as through tube 38. A plasma 90 is generated within the housing of gun 30. The plasma extends out from the housing and heats the surface of rotatable drum 62. The temperature of the plasma is about 10,000° to 12,000° K.

Powdered particles, entrained in a carrier gas, are introduced into the plasma 90 through tube 44. The heat of the plasma 90 is sufficiently high to cause a fusion of the particles as they move through the plasma and are then deposited on the surface of the drum 62. I have found that the plasma from the RF gun as described above will fuse particles of relatively large diameter of more than 100 μm and will cause them to deposit on a receiving surface from essentially a liquid state.

The vacuum system is operated to maintain a pressure of approximately 200 to 400 torr in the low pressure plasma deposition chamber within the container 12. The drum 62 may be rotated within the evacuated chamber as the plasma is used to melt particles into molten droplets to be deposited on the surface thereof.

The power feed mechanism 42 is a conventional commercially available device. One particular model used in the practice of this invention was a powder feeder manufactured by Plasmadyne, Inc. of California. It is equipped with a canister on top that holds the powder. A wheel at the bottom of the canister rotates to feed powder into a powder feed hose 44. The powder is then carried by the carrier gas from the powder feeder along the hose 44 to the chamber 88 of gun 30.

Figure 3:
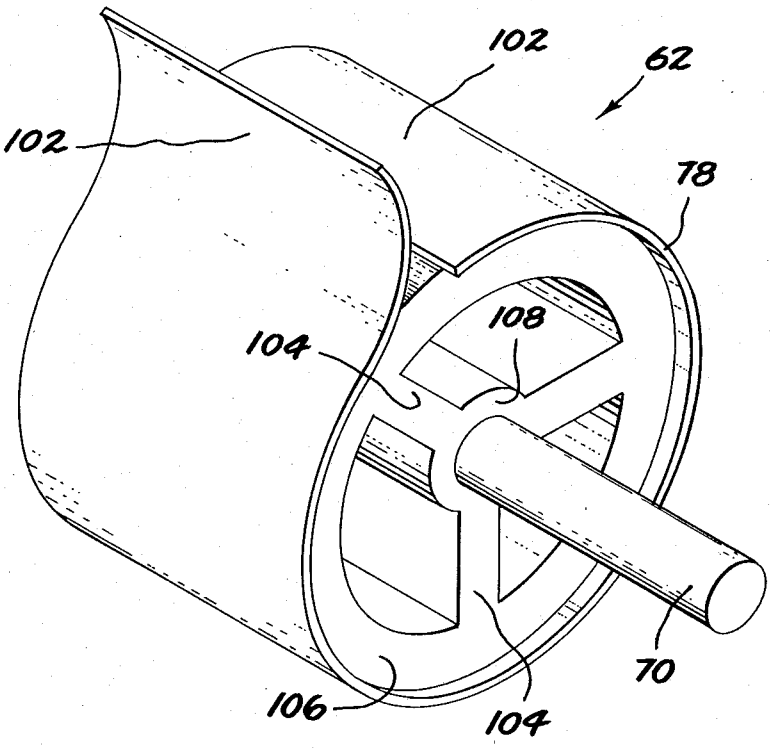
FIG. 3 is a schematic rendering of a drum substrate bearing a preformed foil onto which a high density plasma spray deposit of a titanium base alloy has been made.

Turning now to FIG. 3, a schematic illustration of a drum having a substrate foil mounted partially thereon is provided. The drum 62 is formed to receive a preformed foil, such as 102, on its external surface. The foil desirably extends over the longitudinal edge of the drum so that any material received thereon will deposit on the foil and not on the drum. Drum 62 may be formed with an internal set of ribs 104 extending between an outer wall 106 and an inner central axle 108. A shaft 70 extends outward from axle 108 and is a means by which the drum 62 is supported within a low pressure plasma apparatus such as enclosure 50 of FIG. 2. Foil 102 may be clamped into place on drum 62 by conventional means which are not illustrated in FIG. 3.

In operation, the drum is covered with a foil of metal or with some relatively inexpensive mandrel material. The drum is rotated and translated axially and the plasma flame is played on the foil covered surface of the drum. A powder of the desired alloy composition and particle size is introduced into the plasma powder feed supply and the drum is sprayed in the low pressure plasma deposition apparatus until a plasma spray of desired sheet thickness is obtained on the surface of the substrate foil. For formation of a highly reactive alloy sheet, such as a sheet of titanium alloy, use of larger size powder particles and of a plasma gun powdered by radio frequency is employed in depositing the desired alloy. A radio frequency plasma gun is commercially available and may be obtained from TAFA Corp. of California, USA. A TAFA model 66 may be employed, for example.

At the conclusion of the spraying of the titanium alloy onto the mandrel foil, the preformed foil and the foil deposited thereon are removed from the reusable drum. A steel preformed foil may be chemically dissolved with an acid solution of nitric and hydrochloric acids to remove it from the deposited foil.

Figure 4:
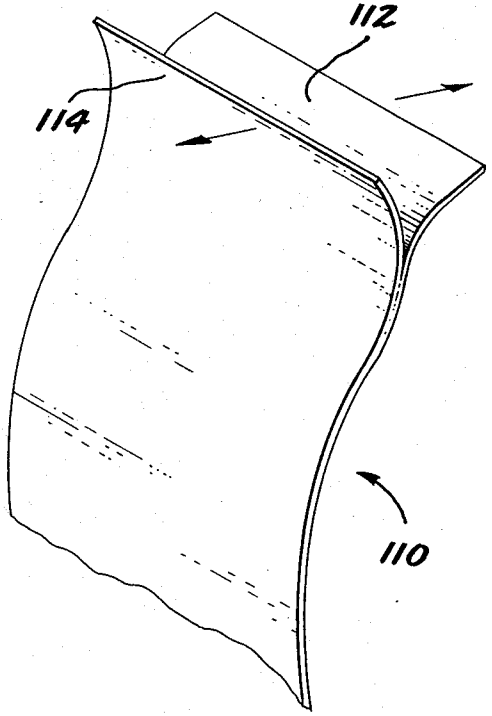
FIG. 4 is a detailed view of a composite foil formed of a titanium base alloy on a preformed foil which may be molybdenum, for example, and showing the two foils being separated from one edge by peeling.

Alternatively, if a substrate sheet of molybdenum metal is employed to receive the titanium alloy sheet deposit, and if during the plasma spraying operation the molybdenum sheet itself does not become excessively heated, then it may not be necessary to employ chemical dissolving agents to remove the molybdenum sheet from the titanium alloy. This is because it has been found possible to separate a preformed sheet of molybdenum from a plasma deposited sheet of titanium alloy by simply peeling the titanium alloy from the molybdenum sheet. This operation is illustrated in FIG. 4, where the composite sheet of molybdenum and titanium 110 is shown to be separating at its upper end into the substrate sheet of molybdenum 112 and the spray formed sheet of titanium alloy 114. Separating tension is applied at one end of the sheet as illustrated by the arrows and the two sheets separate as shown in the figure into their respective individual sheets. Where such separation is carried out, the molybdenum sheet which is recovered is in condition for being reused and may accordingly be reused by mounting molybdenum sheet 112 to drum 79 for deposit of yet another layer of titanium alloy.

A typical run might be carried out under the following conditions:

A power input of 60 Kilowatts

A tank pressure of 250 torr

Gas flow rates for a TAFA Model 66:

| | |
|---|---|
| Radial, Argon | 117 liters/min. |
| Swirl, hydrogen | 5 liters/min. |
| Swirl, argon | 16 liters/min. |
| cold jet argon | 106 liters/min. |

Particle Injection:

| | |
|---|---|
| Carrier, Argon | 5 liters/min. |
| Powder, Ti Base Alloy | 210–250 μm |
| Injection point above nozzle | 7.45 cm. |

Deposition Data:

| | |
|---|---|
| Target Material | Preformed Steel Foil |
| Target Size | 4" wide 7" diam. drum |
| Distance Target Nozzle | 11.5" |
| Preheating Time | none |
| Deposition Time | 3 min. |
| Deposition Rate | 30 grams/min. |
| Mass Deposition efficiency | 90–95% |

EXAMPLE 1

Powder of Ti-6Al-4V (6 weight percent aluminum—4 weight percent vanadium and the balance titanium) alloy was prepared and sieved to have particle sizes between 105 μm and 177 μm.

The powder was plasma spray deposited through an RF powdered plasma gun as described above onto a 0.020 inch thick sheet of steel wrapped on a drum. The drum was 4 inches wide and 7 inches in diameter and the steel sheet was wrapped to completely cover the cylindrical surface of the drum and to fold over the edges onto the flat ends of the drum.

A plasma spray deposit was continued until the titanium alloy deposit had an apparent thickness of about 0.014 inches. The preformed steel sheet with the titanium alloy deposit thereon was removed from the drum and the steel sheet was removed from the titanium deposit. This removal was accomplished by dissolving the steel layer in 50% hot nitric acid solution.

Pieces of the 0.014 inch thick sheet of titanium alloy was then cold rolled on a Fenn Mill.

After several rolling passes through the mill, both with and without a stainless steel pack, the sheet was measured to be 0.008 inches in thickness, thus demonstrating the capability of the as-sprayed RF plasma deposited coarse sheet to undergo substantial reduction of greater than 40% without cracking. The RF plasma as-sprayed deposit of titanium alloy was surprisingly observed to be sufficiently ductile to withstand the rolling stresses without cracking.

In addition the surface roughness of the layer had been significantly improved and the high spots on the sheet surface had been almost completely eliminated.

It should be emphasized that the discovery that the as-sprayed or as-deposited titanium deposit would undergo rolling and substantial thickness reduction was most surprising. This is because, as is explained above, most plasma spray deposited layers have notoriously low ductility and break easily with bending. The as-sprayed deposits must in this respect be distinguished from plasma spray deposits which have been heat treated and which acquire a greatly improved set of properties and characteristics as a result of the heat treatment. For an as-sprayed deposit of a highly reactive metal such as a titanium alloy to undergo such extensive processing as a rolling, and particularly a rolling which results in a 40% reductin is most unique and remarkable in my experience.

A sample of the as-deposited sheet was prepared for microscopic examination. A photomicrograph of a section through the as-deposited sheet is presented in FIG. 5A. The extensive surface irregularities and also the prominent voids present in the as-deposited sheet are evident from this photomicrograph.

Figure 5A:
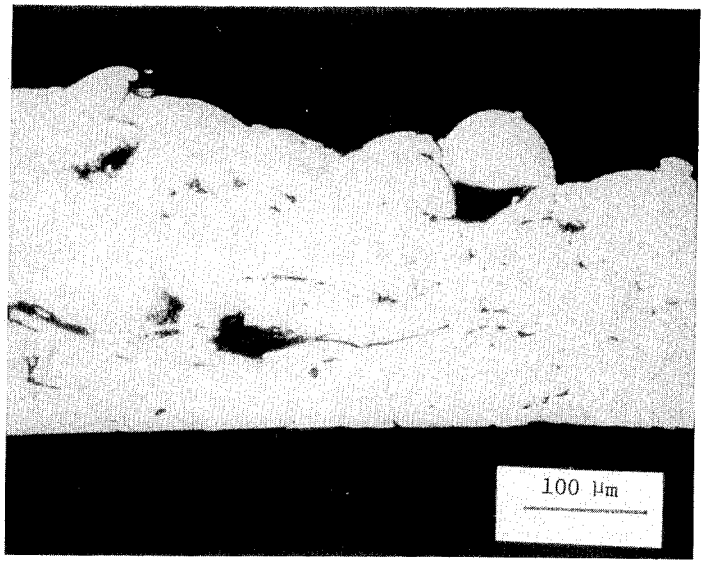
FIGS. 5 and 5B are photomicrographs of plasma spray deposited foil before and after rolling.
Figure 5B:
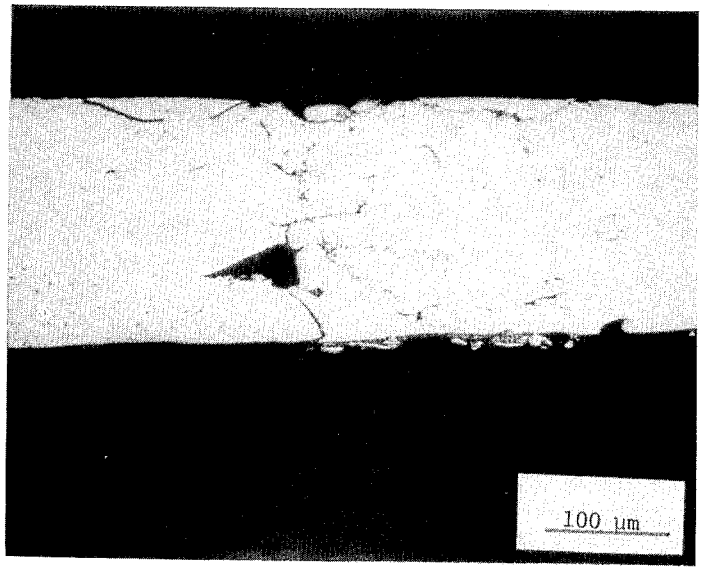

A sample of the rolled sheet was prepared for microscopic examination and a photomicrograph of a section through the rolled sheet is presented in FIG. 5B. The contrast between the properties of the as-sprayed and the as-rolled deposit is readily evident by comparison of the two micrographs. The highly irregular upper surface of the as-sprayed is converted to a highly regular and even smooth upper surface of the as-rolled sheet.

Also, the number and the sizes of the prominent voids of the as-sprayed sample of FIG. 5A are seen to be greatly reduced in the as-rolled specimen sectioned in FIG. 5B.

An important advantage of the smooth surface foil such as may be prepared pursuant to the present invention is that is reduces the potential for damage to reinforcing filaments when the foil is employed as one member of a compact to be consolidated. As is known and as is pointed out in the background statement above a compact of foil and filament array may be formed by sandwiching a number of arrays of aligned reinforcing filaments between alternative layers of titanium base metal foil and the compact can then be consolidated by hot pressing or by hot isotactic pressing. In consolidating such a sandwich compact, there is a danger of damage to the filaments due to the force exerted transversely to the longitudinal axis of the filaments. Breakage of the filaments has been observed to result from such consolidation. Filament breakage can reduce the overall tensile properties of the consolidated composite as the increased tensile strength of such composites is due to the presence of the high strength filaments. Such filaments have tensile strengths of about 400 to 500 ksi whereas the tensile strength of the titanium base alloy may be in the range of about 140 ksi. Transverse fracture of the filaments can accordingly reduce the overall strength of such composites. Surface roughness of the foils used in a sandwich compact which is consolidated into a composite can increase the transverse fracture. Accordingly, the elimination of the surface roughness pursuant to this invention can eliminate this source of fracture and accordingly reduce the overall degree of fracture.

EXAMPLE 2

An intermetallic compound of titanium and aluminum in which the titanium to aluminum atomic ratio is 3 to 1 and in which niobium partially replaces the titanium in the $Ti_3Al$ crystal structure (Ti-14Al-21Cb) was provided in particle form, with the average particle size between 105 μm and 177 μm. The powder material had the overall crystal form of $Ti_3Al$.

The procedure as recited in Example 1 above was repeated and a lyer of the intermetallic compound of about 0.012 inches thickness was formed on the steel sheet.

After separation from the steel sheet parts of the plasma spray deposited layer were rolled on a Fenn Mill as also described in Example 1. The final thickness of the layer after rolling was 0.007 inches.

Again the as-deposited layer was found to be sufficiently ductile to withstand the cold rolling operation.

In this example the concentration of niobium in the intermediate compound is according to the formula Ti-14Al-21Nb by weight. This composition is known to be less ductile than the Ti-6Al-4V material and cannot be rolled to below a 20 mil foil from the ingot. However, I have found that an "as-sprayed" deposit of this alloy can be rolled to provide a very effective foil, free of surface irregularities.

Figure 6A:
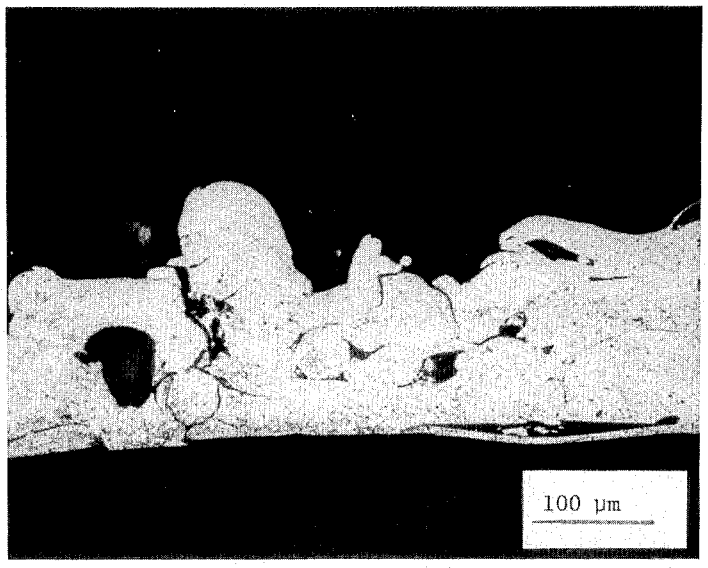
FIGS. 6A and 6B are photomicrographs of plasma spray deposited foils of niobium modified $Ti_3Al$ (Ti-14Al-21Cb) before and after rolling.

A sample of the as-deposited sheet was prepared for microscopic examination. A photomicrograph of a section through the as-deposited sheet is presented in FIG. 6A.

Figure 6B:
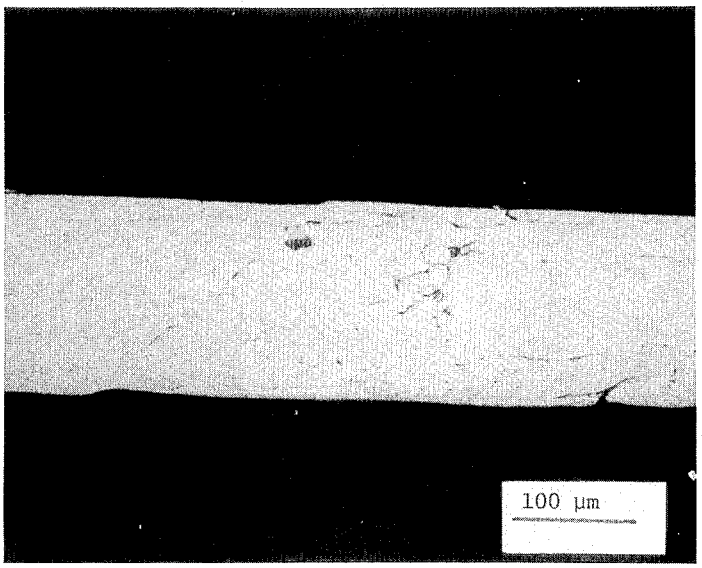

A sample of the as-rolled sheet was prepared for microscopic examination. A photomicrograph of a section through the as-rolled sheet is presented in FIG. 6B.

Fabrication of thin titanium base alloy sheet from formation of a composite can be very costly. This is particularly so if the titanium alloy is not ductile at room temperature. One alloy which lacks such room temperature ductility is niobium modified intermetallic compound having the crystal from of $Ti_3Al$. This alloy can only be rolled from the ingot to foils of about ;b 0.020 inch thick. To obtain thinner sheet by prior art methods requires that the thicker sheet be electrochemically machined to the desired thickness. If the final desired thickness is 0.010 inch, then about half of the original material is lost by the prior art practice.

However, as is evident from the above example, the preparation of a foil of niobium modified $Ti_3Al$ of 0.010 inch or of larger or smaller dimensions is readily feasible without encountering the expense of the prior art practices.

Also, the foil which is prepared according to the teachings of this example, has two smooth surfaces because of the unique finding that an as-sprayed deposit is capable of being cold rolled to greatly improve the surface characteristics without fracture.

What is claimed is:

1. A method of forming a thin sheet of a titanium alloy which comprises providing a RF powered plasma gun, providing a supply of powder of the titanium alloy to be formed into a sheet, said powder having a particle size of greater than about 100 μm, supplying said powder to a plasma in said gun to cause a plasma deposit of said powder to form on a receiving surface, separating said plasma deposit from said surface as a free standing sheet having at least one rough surface, rolling the as-deposited sheet to reduce the thickness of said sheet and to increase the smoothness of the surfaces thereof.

2. The method of claim 1 in which the particle size of the powder is between about 100 μm and 250 μm.

3. The method of claim 1 in which the alloy is Ti-6Al-4V.

4. The method of claim 1 in which the thickness reduction is greater than 40%.

5. The method of forming a composite of high strength fibers in a titanium alloy matrix which comprises providing the titanium alloy in the form of powder having particles of at least 100 μm, plasma spray depositing the powder onto a substrate to form a rough surface titanium alloy sheet, separating the titanium alloy sheet from the substrate, rolling the titanium alloy sheet to reduce the roughness of its surface, including the sheet in a compact of alternate layers of titanium alloy and reinforcing fiber, and HIPing the compact to form a reinforced composite of titanium alloy and reinforcing fibers.

6. The method of claim 5 in which the particle size of the powder is between about 100 μm and 250 μm.

7. The method of claim 5 in which the titanium alloy powder is Ti-6Al-4V.

8. The method of claim 5 in which the thickness reduction is greater than 40%.

9. The method of claim 5 in which the reinforcing fiber is silicon carbide fiber.

10. The method of claim 1 in which the alloy is Ti-14Al-21Cb by weight.

11. The method of claim 5 in which they alloy is Ti-14Al-21Cb by weight.

* * * * *